US008567376B2

(12) United States Patent
Flint

(10) Patent No.: US 8,567,376 B2
(45) Date of Patent: Oct. 29, 2013

(54) PROJECTILE LAUNCHING DEVICE

(76) Inventor: Wilson Flint, Albuquerque, NM (US)

( * ) Notice: Subject to any disclaimer, the term of this patent is extended or adjusted under 35 U.S.C. 154(b) by 258 days.

(21) Appl. No.: 13/084,818

(22) Filed: Apr. 12, 2011

(65) Prior Publication Data

US 2011/0277736 A1 Nov. 17, 2011

Related U.S. Application Data

(60) Provisional application No. 61/324,209, filed on Apr. 14, 2010.

(51) Int. Cl.
*F41B 3/02* (2006.01)
*F41B 5/12* (2006.01)

(52) U.S. Cl.
USPC ..... 124/20.3; 124/25

(58) Field of Classification Search
USPC ..... 124/20.1, 20.3, 21, 22, 25
See application file for complete search history.

(56) References Cited

U.S. PATENT DOCUMENTS

| | | | | |
|---|---|---|---|---|
| 1,261,992 | A * | 4/1918 | Algie | 124/21 |
| 2,638,885 | A * | 5/1953 | Keadle | 124/20.1 |
| 3,783,852 | A * | 1/1974 | Shepherd | 124/22 |
| 4,458,658 | A * | 7/1984 | Blair | 124/20.1 |
| 5,243,955 | A * | 9/1993 | Farless | 124/20.1 |
| 5,762,056 | A * | 6/1998 | Kysilka | 124/20.3 |
| 6,273,078 | B1 * | 8/2001 | Schwesinger | 124/16 |

* cited by examiner

*Primary Examiner* — John Ricci
(74) *Attorney, Agent, or Firm* — Nydegger & Associates

(57) ABSTRACT

A projectile launcher includes an acceleration rail with an accelerator mounted on opposite sides of the rail. Each accelerator includes an elastomeric energy generator having an end that is held stationary, while another end is connected to a string. This string then passes over a series of pulleys and crosses over the rail into the other accelerator. Thus, both accelerators act on the same string. In operation, as the string is pulled back and engaged with the projectile on the acceleration rail, the elastomeric drives are stretched. Also, each series of pulleys effectively causes a velocity multiplication that enhances the momentum of the projectile when it is launched.

17 Claims, 3 Drawing Sheets

PROJECTILE LAUNCHING DEVICE

This application claims the benefit of U.S. Provisional Patent Application Ser. No. 61/324,209, filed Apr. 14, 2010.

FIELD OF THE INVENTION

The present invention pertains generally to man-powered weapons. More particularly, the present invention pertains to weapons that allow an individual to configure the weapon with their own physical strength, to thereby establish sufficient energy for effectively launching projectiles with a momentum required for activities such as "big game" hunting. The present invention is particularly, but not exclusively, useful as a man-powered weapon that can be handled, aimed and operated with enhanced power and accuracy.

BACKGROUND OF THE INVENTION

All man-powered weapons rely on the inherent capability of the weapon to be operationally armed by an individual. Essentially, this means that a single individual must be able to, somehow, reconfigure or manipulate the weapon so that it has sufficient potential energy to effectively launch a projectile. In particular, no chemical reaction, such as the explosion of gun powder, is involved in the operation of a man-powered weapon. Traditionally, man-powered weapons have generally included air-pump guns, slings, blow-guns, bow-and-arrow sets, and crossbows. Of these, the bow-and-arrow and crossbow have clearly been the most versatile and powerful. And, of these, the crossbow is arguably the most powerful. A traditional crossbow, however, has its shortcomings. Most notably, a traditional crossbow is front-end heavy and, consequently, is somewhat difficult to manipulate during hunting.

An important consideration of any man-powered weapon is its mechanical compatibility with the projectile that is to be launched. The follow-on consideration from this involves the efficacy of the projectile itself. Recent studies have indicated that, in a hunting context, the momentum of a projectile is often more important than its velocity. A generalized consequence of this observation is that for an elongated projectile, the center of mass needs to be nearer the front end of the projectile. Further, for improved accuracy, it is preferable that a measure of the location for the center of mass, referred to as the percent Forward of Center (% FOC), be around 25% or greater. Mathematically, where "L" is the length of the projectile's shaft (aft of the broadhead), and where "x" is the distance from the tail end of the projectile to center, the % FOC can be calculated using the expression:

$$\% \text{ FOC}=(x/L-½)100$$

From the above, it then follows that the weapon (i.e. launcher) must effectively accommodate such a projectile.

For purposes of hunting "big game", or even small game for that matter, silence is a valued capability for a man-powered weapon. More specifically, it is desirable that a man-powered weapon have minimal, if any, report. Equally important is the ability of a hunter (user) to handle and aim the weapon easily and accurately. For a rifle or shotgun, this ability is essentially an inherent characteristic of the weapon. As implied above, with reference to a traditional crossbow, this is not necessarily so for a man-powered weapon.

In light of the above, it is an object of the present invention to provide a man-powered projectile launcher having increased accuracy. Still another object of the present invention is to provide a man-powered launcher that is capable of shooting a projectile with high momentum. Yet another object of the present invention is to provide a projectile launcher that is rugged and relatively noiseless, i.e. it has good mechanical and acoustic containment. A further object of the present invention is to provide a projectile launcher that is relatively simple to manufacture, is easy to use, and is comparatively cost effective.

SUMMARY OF THE INVENTION

A projectile launcher in accordance with the present invention provides a high momentum launch for projectiles using at least one elastomeric drive unit. An important feature of the invention is the incorporation of a launcher design that can be made to either push or pull the projectile for acceleration during launch. Another important feature is the noise suppression that is provided by the launcher design.

Structurally, the projectile will preferably include a projectile head with a long, straight cylindrical shaft extending from the head. The projectile launcher itself includes an elongated base member that is formed with an acceleration rail. And, a sled is mounted on the base member for reciprocal linear movement along the acceleration rail. The sled is configured to receive the head portion of the projectile and, preferably, the head portion of the projectile is magnetically held on the sled. In any event, an engagement of the head of the projectile with the sled must stabilize the projectile on the sled until the projectile has been launched.

In addition to the acceleration rail, a preferred embodiment of the launcher includes a pair of accelerators. More specifically, a first accelerator is mounted on one side of the base member, and a second accelerator is mounted on the other side of the base member, opposite the acceleration rail from the first accelerator. A string is provided, and a first end of the string is affixed to a stationary point on the first accelerator. Similarly, a second end of the string is affixed to a stationary point on the second accelerator. Within this arrangement, the string crosses over the acceleration rail between the first accelerator and the second accelerator. As the string crosses the acceleration rail it is engaged with the sled.

An important feature of the present invention is that each accelerator is housed inside a noise-suppression tube. For this feature, each noise-suppression tube is a hollow structure, and it has a base end and a deployment end. The base end of each noise-suppression tube is pivotally mounted on opposite sides of the base member as implied above. Within this structure, each accelerator includes an elastomeric drive unit. Inside each respective noise-suppression tube, a first end of the drive unit is affixed to the base end of the tube, and a velocity multiplier pulley is attached to the second end of the drive unit. Importantly, the velocity multiplier pulley is attached for movement with the second end of the drive unit. The accelerator also includes an external deployment pulley that is fixedly attached to the deployment end of the noise-suppression tube. With this structure, an end of the string is affixed to the deployment end of the noise-suppression tube. The string then extends through the interior of the noise-suppression tube for successive engagements with the velocity multiplier pulley and the external deployment pulley. The string then exits from the noise-suppression tube for its engagement with the sled on the acceleration rail of the base member.

In addition to the structure disclosed above, each accelerator also includes a rigid truss member that facilitates arming and firing the launcher. In detail, the truss member has a first end that is pivotally attached to the deployment end of the noise-suppression tube. The truss member also has a second end that is engaged with the base member, to slide along the base member between a first location and a second location. With a movement of the second end of the truss member from its first location to its second location, the accelerator is reconfigured from an unloaded configuration to a pre-load configuration. In its unloaded configuration, the noise-suppression tube is substantially parallel to the base member. In its pre-load configuration, however, the noise-suppression tube is pivoted at its base end to establish an angle ϕ between the noise-suppression tube and the acceleration rail of the base member. The consequence of this reconfiguration is that the drive unit is stretched from an unloaded state and into a pre-load state.

With the accelerators of the projectile launcher in a pre-load state, an arming of the launcher is accomplished by pulling the sled back along the acceleration rail to an armed-for-launch (i.e. loaded) position that is located near the base ends of the accelerators. By positioning the sled in this armed position on the acceleration rail, both accelerators are simultaneously activated. If not already engaged, the head of the projectile can then be placed on the sled. For launch, a trigger releases the sled from the armed (loaded) position and this pulls on the head portion of the projectile to release useful stored energy for launching the projectile.

In an alternate embodiment of the present invention, a single accelerator can be used. For this embodiment, instead of the string passing through the sled for its engagement with the sled, the string is attached directly to the sled. A braking mechanism for the sled is provided for this embodiment.

An adaptation of the present invention that employs the concepts of a compound bow involves a three-string structure for use with the accelerators. Specifically, this embodiment of the invention employs a single draw string that extends between the deployment ends of the accelerators. And, it employs a separate drive string for each accelerator. Further, for this embodiment, each accelerator incorporates a dual cam that is mounted for rotation at the deployment end of each respective noise-suppression tube. Structurally, each dual cam includes a drive cam that is affixed and juxtaposed to a draw cam. Importantly, the drive cam and the draw cam are affixed to each other, for rotation with each other. Within this structure, the draw string is engaged between respective draw cams of the two accelerators, and each separate drive string is engaged between a drive cam and a respective drive unit in the noise-suppression tube of the accelerator. During a pull on the draw string, the draw cam radius increases non-linearly, while the drive cam radius decreases at the end of the draw. Together, these simultaneous actions achieve a combined action similar to a compound bow.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
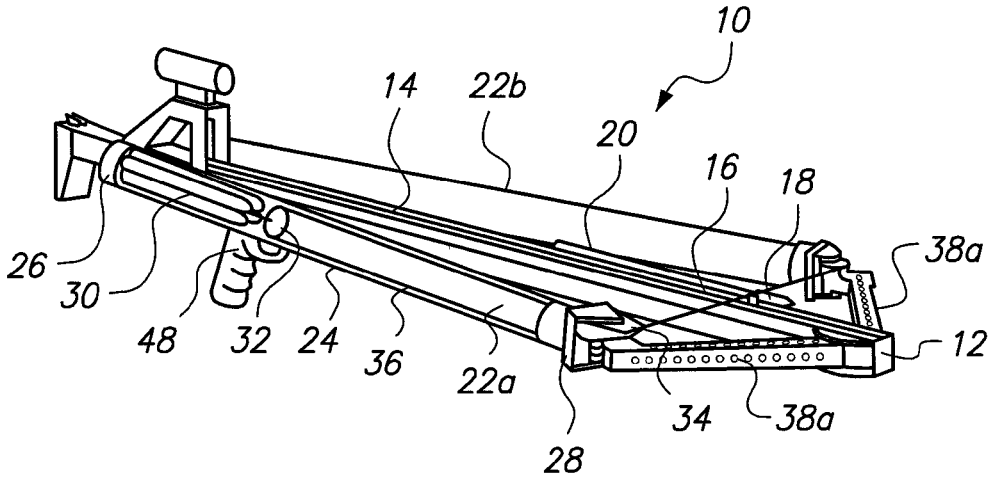
FIG. 1 is a perspective view of the projectile launcher in accordance with the present invention with portions broken away for clarity.

Referring initially to FIG. 1, a projectile launcher in accordance with the present invention is shown and is generally designated 10. As shown, the launcher 10 includes a base member 12 that is formed with an acceleration rail 14. Further, a sled 16 is shown mounted on the acceleration rail 14 for reciprocal movement thereon. A projectile is also shown in FIG. 1, with the projectile having a projectile head 18, with an elongated projectile shaft 20 extending from the projectile head 18. More specifically, the projectile head 18 is shown engaged with the sled 16. Preferably, this engagement is accomplished magnetically.

Still referring to FIG. 1, it will be seen that the launcher 10 includes a pair of accelerators 22*a* and 22*b*. In detail, the accelerators 22*a* and 22*b* each include a noise suppression tube 24 and they are positioned on opposites sides of the base member 12. Using the accelerator 22*a* as an example for disclosure purposes, it will be seen that the accelerator 22*a* has a base end 26 and a deployment end 28. As shown, the base end 26 of the accelerator 22*a* is mounted on the base member 12 for rotation between an unloaded configuration (see FIG. 2A) and a pre-load configuration (see FIG. 2B). In the unloaded configuration for launcher 10 (FIG. 2A), the accelerators 22*a* and 22*b* are aligned substantially parallel to the base member 12. On the other hand, in the pre-load configuration for launcher 10 (FIG. 2B), the accelerators 22*a* and 22*b* are each pivoted at their base end 26 and are splayed to establish an angle "ϕ" between the respective accelerators 22*a* and 22*b* and the base member 12.

Still referring to FIG. 1, and still using the accelerator 22*a* as an example, within the noise suppression tube 24 it will be seen that the accelerator 22*a* includes a drive unit 30 that is preferably made of a stretchable elastomeric material. It could, however, be made as a spring or as some other type mechanism known in the pertinent art that will store energy when stretched. In any event, one end of the drive unit 30 is fixed at the base end 26 of the accelerator 22*a*, and the other end of the drive unit 30 is fixed to a velocity multiplier pulley 32. FIG. 1 also indicates that a deployment (base) pulley 34 is mounted on the accelerator 22*a* at its deployment end 28.

Figure 3A:
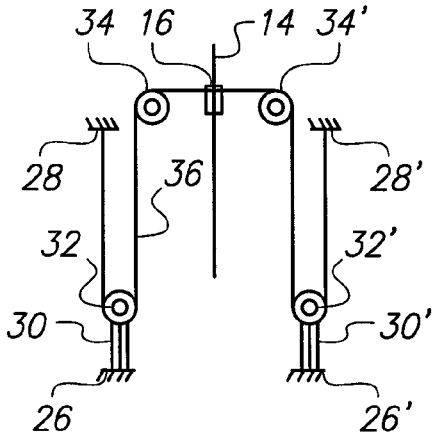
FIG. 3A is a schematic representation of the accelerators of the projectile launcher in a pre-load condition.
Figure 3B:
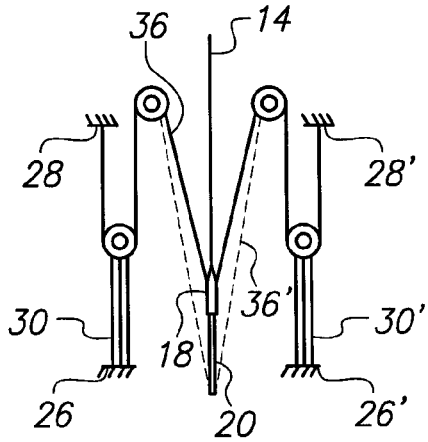
FIG. 3B is a schematic representation of the accelerators of the projectile launcher in a loaded condition showing both a "pull" and a "push" configuration for the launcher.

As perhaps best seen in FIG. 3A, the launcher 10 includes a launching string 36 that is interconnected between the deployment end 28 of the accelerator 22*a*, and the deployment end 28' of the accelerator 22*b*. More specifically, for this interconnection the string 36 is fixed at the deployment end 28 of accelerator 22*a* and extends therefrom for engagement with the velocity multiplier pulley 32. It then extends back from the velocity multiplier pulley 32 to the deployment (base) pulley 34. After the string 36 exits from the accelerator 22*a* at the deployment (base) pulley 34, it then crosses over the acceleration rail 14 where it engages with the sled 16. From the sled 16, the string 36 enters the accelerator 22*b*. The string 36 then successively engages with deployment (base) pulley 34' and velocity multiplier pulley 32' before it is fixed at deployment end 28' of accelerator 22*b*. Within the accelerator 22*b*, the drive unit 30' interconnects the velocity multiplier pulley 32' with base end 26' in the same manner as corresponding components are incorporated in accelerator 22*a*. In comparison with FIG. 3B, FIG. 3A shows the string 36 as it will be deployed when the launcher 10 is in a pre-load configuration. On the other hand, FIG. 3B shows the string 36 in a configuration wherein the launcher 10 is armed. With reference to FIG. 3B, it is to be appreciated that in an alternate embodiment of the launcher 10 the string 36 can be engaged with a nock (not shown) at the rear of projectile shaft 20. For this embodiment, the projectile head 18 is launched with a pushing action and does not necessarily require use of the sled 16. In any event, it will be appreciated by the skilled artisan that a "push" or a "pull" action can be accomplished with or without a sled 16.

Figure 2A:
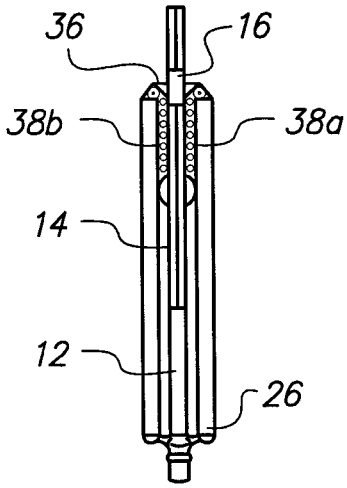
FIG. 2A is a top plan view of the projectile launcher in an unloaded configuration.
Figure 2B:
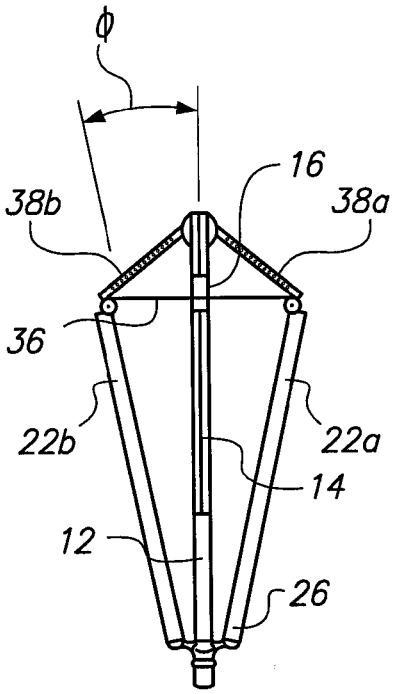
FIG. 2B is a top plan view of the projectile launcher in a pre-load configuration.

Returning to FIG. 1, it will be seen that the launcher 10 also includes a pair of truss members 38*a* and 38*b* that, respectively, support the accelerators 22*a* and 22*b* on the base member 12. With reference to FIGS. 2A and 2B, it will be seen that these truss members 38*a* and 38*b* are substantially aligned with the base member 12 when the launcher 10 is unloaded (FIG. 2A). When the launcher 10 is placed in its pre-load configuration however (FIG. 2B), the truss members 38*a* and 38*b* are splayed to interconnect the deployment ends 28 of the accelerators 22*a* and 22*b* with the base member 12. Thus, in operation, the truss members 38*a* and 38*b* support and stabilize the accelerators 22*a* and 22*b* during a firing of the launcher 10.

Figure 4:
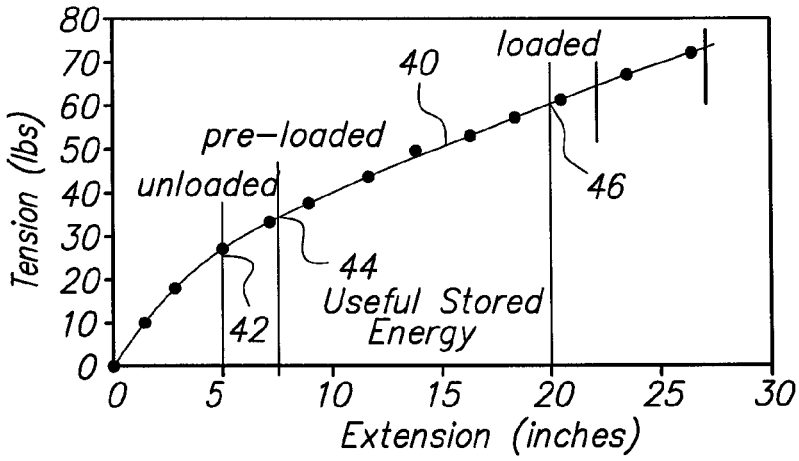
FIG. 4 is a graph showing the relationship between string extension and string tension for various conditions of the accelerators.

An operation of the launcher 10 will be better appreciated with reference to FIG. 4. In detail, the graph line 40 in FIG. 4 shows the relationship between the extensions of the drive unit 30 and the resultant tension force that are thereby generated in the drive unit 30. As will be appreciated by the skilled artisan, the area under this graph line 40 between points 44 and 46 is indicative of the useful energy (i.e. potential energy) that is stored in the drive unit 30. With this in mind, an operation of the launcher 10 starts with an unloaded launcher 10, in a configuration as shown in FIG. 2A. This unloaded configuration corresponds to a nominal extension of the drive unit 30 and generally corresponds to the point 42 indicated in FIG. 4. It is an important aspect of the present invention that this unloaded configuration still imparts a tension on the drive unit 30. Specifically, the slight tension of the unloaded configuration avoids adverse effects of hysteresis. From this start point, i.e., the unloaded configuration, it will be appreciated that the pre-load can actually be performed either before or after the full load configuration.

From an unloaded configuration, the accelerators 22*a* and 22*b* are then splayed, along with the truss members 38*a* and 38*b*, to reconfigure the launcher 10 into its pre-load (operational) configuration as shown in FIG. 2B. This pre-load (operational) configuration (FIG. 2B) corresponds to a short extension of the drive unit 30 as indicated by point 44 in FIG. 4. Note: for purposes of disclosure, when the launcher 10 is in its pre-load (operational) configuration (FIG. 2B), the string 36 is positioned substantially as shown in FIG. 3A. Loading (i.e. arming) the launcher 10 simply requires withdrawing the sled 16 along the acceleration rail 14, and engaging the projectile head 18 with the sled 16. Or, as disclosed below, the projectile shaft 20 can be engaged directly with the string 36. In either case, after the launcher 10 has been loaded (i.e. armed), the string 36 will be positioned substantially as shown in FIG. 3B. This corresponds to the point 46 in FIG. 4. The launcher 10 can then be fired by manipulation of the trigger mechanism 48 (see FIG. 1). As will be appreciated by the skilled artisan, a withdrawal of the sled 16 (string 36) to arm the launcher 10 can be accomplished in any manner well known in the pertinent art, such as manually, with toothed belt and pulley, quick-release lead screws, a compact winch, a bicycle-style chain, or multi-stepping sheep's foot.

Figure 5:
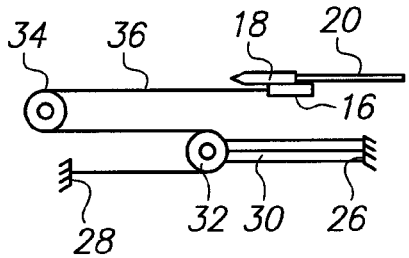
FIG. 5 is a schematic representation of an alternate embodiment of the projectile launcher having a single accelerator configured for a "pull" action on the projectile.

With reference to FIG. 5, it will be appreciated that the present invention envisions variations in embodiments of mechanisms that operate in lieu of the pair of accelerators 22*a* and 22*b* disclosed above. Specifically, for the embodiment shown in FIG. 5, a single accelerator 22 may be used. In this embodiment, the acceleration rail 14 can be narrowed at its distal end to provide a breaking action for the sled 16. In another variation, a mechanism is provided that incorporates structure having the arming characteristics of a compound bow. Such an embodiment for the present invention is shown in FIGS. 6A-C.

Figure 6A:
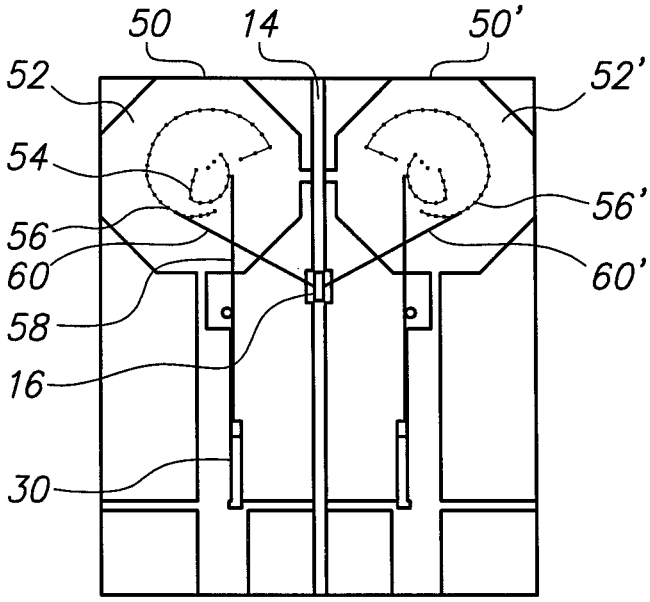
FIGS. 6A-C illustrate a sequence of configurations for dual-cam accelerators when employed to achieve a compound bow action.
Figure 6B:
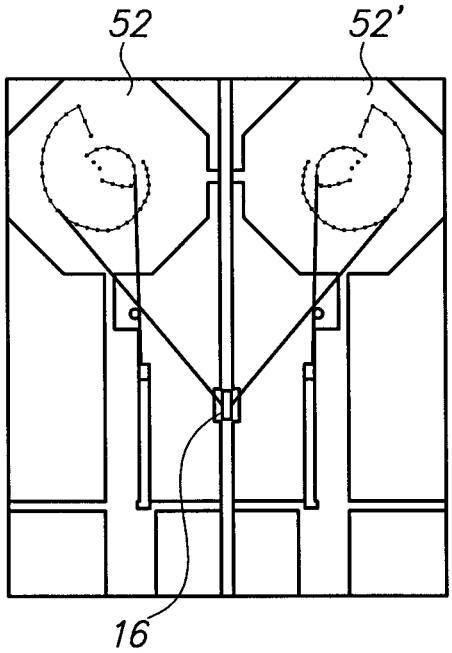
Figure 6C:
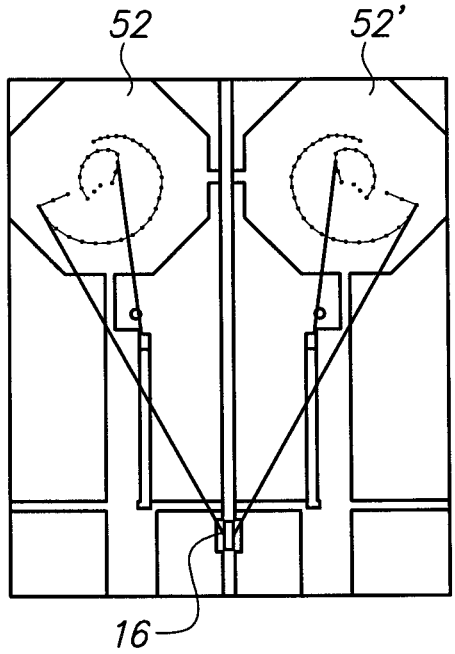

In FIG. 6A, a dual cam mechanism 50 is shown to include a cam plate 52 on which are mounted both a power cam 54 and a launch cam 56. Importantly, both of the cams 54 and 56 rotate together with the cam plate 52. FIG. 6A also shows that a launcher 10 that incorporates a cam mechanism 50 will typically also incorporate a corresponding cam mechanism 50'. For purposes of disclosure, the cam mechanism 50 will be described and considered exemplary of other such mechanisms (i.e. cam mechanism 50').

Along with the power cam 54 and the launch cam 56, FIG. 6A shows that cam mechanism 50 includes a power line 58 interconnecting the power cam 54 with the drive unit 30. It is also shown that the cam mechanism 50 includes a launch line 60 interconnecting the launch cam 56 of cam mechanism 50 with the launch cam 56' of cam mechanism 50'. Further, the launch line 60 is shown crossing the acceleration rail 14 and engaging with the sled 16. Consequently, when the sled 16 is withdrawn along the acceleration rail 14, the launch line 60 is guided by the launch cams 56 to simultaneously rotate the respective cam plates 52 and 52' of the mechanisms 50 and 50'. As the cam plates 52 and 52' rotate, the power cams 54 on each cam plate 52 also rotate and pull on their respective power lines 58. This causes the drive units 30 to extend (see FIGS. 6B and 6C sequentially) and thereby store energy for the subsequent launch of a projectile (not shown in FIGS. 6A-C).

While the particular Projectile Launching Device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A projectile launcher, wherein the projectile has a head portion with a shaft extending from the head portion, the launcher comprising:

a base member having an elongated acceleration rail;

a sled mounted on the base member for reciprocal linear movement along the acceleration rail, wherein the sled is configured to receive the head portion of the projectile;

a first accelerator mounted on the base member;

a second accelerator mounted on the base member opposite the acceleration rail from the first accelerator;

a string having a first end and a second end, with the first end affixed to a stationary point on the first accelerator and with the second end affixed to a stationary point on the second accelerator, wherein the string crosses the acceleration rail between the first accelerator and the second accelerator for an engagement of the string with the sled;

a means for positioning the sled in an armed position on the acceleration rail to simultaneously activate both the first accelerator and the second accelerator;

a trigger means for releasing the sled from the armed position to pull on the head portion of the projectile for launching the projectile;

a first noise-suppression tube, wherein the first tube is hollow and has a base end and a deployment end, wherein the base end of the first tube is pivotally mounted on the base member, and further wherein the first accelerator is held inside the first noise-suppression tube; and a second noise-suppression tube, wherein the second tube is hollow and has a base end and a deployment end, and wherein the base end of the second tube is pivotally mounted on the base member, and further wherein the second accelerator is held inside the second noise-suppression tube.

2. A launcher as recited in claim 1 wherein the first accelerator and the second accelerator each comprise:

a drive unit having a first end and a second end, with the first end of the drive unit affixed to the base end of the noise-suppression tube;

a base pulley fixedly attached to the deployment end of the noise-suppression tube; and a velocity multiplier pulley attached to the second end of the drive unit for movement therewith, wherein the string is affixed to the deployment end of the tube and extends therefrom for successive engagement with the velocity multiplier pulley, the base pulley, and the sled.

3. A launcher as recited in claim 2 wherein the drive unit is made of an elastomeric material.

4. A launcher as recited in claim 2 wherein each accelerator further comprises a rigid truss member having a first end and a second end, wherein the first end is pivotally attached to the deployment end of the noise-suppression tube, and the second end is engaged with the base member to slide thereon for movement of the second end to reconfigure the accelerator between an unloaded configuration wherein the noise-suppression tube is substantially parallel to the base member and a pre-load configuration wherein the noise-suppression tube is pivoted at the base end thereof to establish an angle $\phi$ between the tube and the base member.

5. A projectile launcher which comprises:

a base member having an elongated acceleration rail;

a sled mounted on the base member for reciprocal linear movement along the acceleration rail, wherein the sled is configured to receive the projectile;

a first noise-suppression tube mounted on the base member, wherein the first tube is hollow and has a base end and a deployment end, wherein the base end of the first tube is pivotally mounted on the base member;

a second noise-suppression tube, wherein the second tube is hollow and has a base end and a deployment end, and wherein the base end of the second tube is pivotally mounted on the base member opposite the acceleration rail from the first tube;

a first accelerator held inside the first noise-suppression tube;

a second accelerator held inside the second noise-suppression tube;

a string having a first end and a second end with the first end affixed between the first accelerator and the second accelerator, wherein the string crosses the acceleration rail between the first tube and the second tube for an engagement of the string with the sled;

a means for positioning the sled in an armed position on the acceleration rail to simultaneously activate both the first accelerator and the second accelerator; and a trigger means for releasing the sled from the armed position to launch the projectile.

6. A launcher as recited in claim 5 wherein the projectile has a head portion with a shaft extending from the head portion, and wherein the sled is configured to receive the head portion of the projectile.

7. A launcher as recited in claim 5 wherein the first accelerator and the second accelerator each comprise:

a drive unit having a first end and a second end, with the first end of the drive unit affixed to the base end of the noise-suppression tube;

a base pulley fixedly attached to the deployment end of the noise-suppression tube; and a velocity multiplier pulley attached to the second end of the drive unit for movement therewith, wherein the string is affixed to the deployment end of the tube and extends therefrom for successive engagement with the velocity multiplier pulley, the base pulley, and the sled.

8. A launcher as recited in claim 7 wherein the drive unit is made of an elastomeric material.

9. A launcher as recited in claim 7 wherein each accelerator further comprises a rigid truss member having a first end and a second end, wherein the first end is pivotally attached to the deployment end of the noise-suppression tube, and the second end is engaged with the base member to slide thereon for movement of the second end to reconfigure the accelerator between an unloaded configuration wherein the noise-suppression tube is substantially parallel to the base member and a pre-load configuration wherein the noise-suppression tube is pivoted at the base end thereof to establish an angle $\phi$ between the tube and the base member.

10. A projectile launcher, wherein the projectile has a head portion with a shaft extending from the head portion, the launcher comprising:

a base member having an elongated acceleration rail;

a sled mounted on the base member for reciprocal linear movement along the acceleration rail, wherein the sled is configured to receive the head portion of the projectile;

an accelerator mounted on the base member;

a string having a first end and a second end, with the first end affixed to a stationary point on the accelerator and with the second end engaged with the sled;

a means for positioning the sled in an armed position on the acceleration rail to activate the accelerator;

a trigger means for releasing the sled from the armed position to pull on the head portion of the projectile for launching the projectile; and a means for braking the sled after launch.

11. A launcher as recited in claim 10 wherein the accelerator is a first accelerator and the launcher further comprises a second accelerator mounted on the base member opposite the acceleration rail from the first accelerator, wherein the string has a first end and a second end, with the first end affixed to a stationary point on the first accelerator and with the second end affixed to a stationary point on the second accelerator, wherein the string crosses the acceleration rail between the first accelerator and the second accelerator for an engagement of the string with the sled, and further wherein the means for positioning the sled in the armed position on the acceleration rail simultaneously activates both the first accelerator and the second accelerator.

12. A launcher as recited in claim 11 wherein the first accelerator and the second accelerator each comprise:

a drive unit having a first end and a second end, with the first end of the drive unit affixed to the base end of a noise-suppression tube;

a base pulley fixedly attached to the deployment end of the noise-suppression tube; and a velocity multiplier pulley attached to the second end of the drive unit for movement therewith, wherein the string is affixed to the deployment end of the tube and extends therefrom for successive engagement with the velocity multiplier pulley, the base pulley, and the sled.

13. A launcher as recited in claim 12 wherein the drive unit is made of an elastomeric material.

14. A launcher as recited in claim 12 wherein each accelerator further comprises a rigid truss member having a first end and a second end, wherein the first end is pivotally attached to the deployment end of the noise-suppression tube, and the second end is engaged with the base member to slide thereon for movement of the second end to reconfigure the accelerator between an unloaded configuration wherein the noise-suppression tube is substantially parallel to the base member and a pre-load configuration wherein the noise-suppression tube is pivoted at the base end thereof to establish an angle $\phi$ between the tube and the base member.

15. A projectile launcher, wherein the projectile has a head portion with a shaft extending from the head portion, the launcher comprising:

a base member having an elongated acceleration rail;

a first accelerator mounted on the base member;

a second accelerator mounted on the base member opposite the acceleration rail from the first accelerator;

a string having a first end and a second end, with the first end affixed to a stationary point on the first accelerator and with the second end affixed to a stationary point on the second accelerator, wherein the string crosses the acceleration rail between the first accelerator and the second accelerator for an engagement with the string;

a means for positioning the string in an armed position on the acceleration rail to simultaneously activate both the first accelerator and the second accelerator;

a trigger means for releasing the string from the armed position to accelerate the projectile for launching the projectile;

a first noise-suppression tube, wherein the first tube is hollow and has a base end and a deployment end, wherein the base end of the first tube is pivotally mounted on the base member, and further wherein the first accelerator is held inside the first noise-suppression tube; and a second noise-suppression tube, wherein the second tube is hollow and has a base end and a deployment end, and wherein the base end of the second tube is pivotally mounted on the base member, and further wherein the second accelerator is held inside the second noise-suppression tube.

16. A launcher as recited in claim 15 wherein the first accelerator and the second accelerator each comprise:

a drive unit having a first end and a second end, with the first end of the drive unit affixed to the base end of the noise-suppression tube;

a base pulley fixedly attached to the deployment end of the noise-suppression tube; and a velocity multiplier pulley attached to the second end of the drive unit for movement therewith, wherein the string is affixed to the deployment end of the tube and extends therefrom for successive engagement with the velocity multiplier pulley and the base pulley.

17. A launcher as recited in claim 15 wherein the string pushes on the projectile to launch the projectile.

* * * * *